US010315056B2

(12) United States Patent
Klinke et al.

(10) Patent No.: US 10,315,056 B2
(45) Date of Patent: Jun. 11, 2019

(54) BELAY DEVICE

(71) Applicant: Great Trango Holdings, Inc., Louisville, CO (US)

(72) Inventors: Christopher Klinke, Lafayette, CO (US); Seth GaleWyrick, Philadelphia, PA (US); Adam Sanders, Lafayette, CO (US); Andrew Weiman, Philadelphia, PA (US)

(73) Assignee: Great Trango Holdings, Inc., Louisville, CO (US)

( * ) Notice: Subject to any disclaimer, the term of this patent is extended or adjusted under 35 U.S.C. 154(b) by 21 days.

(21) Appl. No.: 15/646,812

(22) Filed: Jul. 11, 2017

(65) Prior Publication Data

US 2018/0008844 A1 Jan. 11, 2018

Related U.S. Application Data

(60) Provisional application No. 62/360,838, filed on Jul. 11, 2016.

(51) Int. Cl.
*A62B 1/14* (2006.01)
*A63B 29/02* (2006.01)

(52) U.S. Cl.
CPC ..... *A62B 1/14* (2013.01); *A63B 29/02* (2013.01)

(58) Field of Classification Search
CPC ..... A62B 1/14; A63B 29/02
See application file for complete search history.

(56) References Cited

U.S. PATENT DOCUMENTS

| | | | |
|---|---|---|---|
| 946,588 | A | 1/1910 | Thuener |
| 3,814,210 | A | 6/1974 | Hoffman |
| 3,876,036 | A | 4/1975 | Sweet |
| 4,399,889 | A | 8/1983 | Todd |
| 4,494,629 | A | 1/1985 | Raeburn |
| 4,580,658 | A | 4/1986 | Brda |
| 4,596,314 | A | 6/1986 | Rogelja |
| 5,076,400 | A | 12/1991 | Petzl |
| 5,845,894 | A | 12/1998 | Petzl |
| 5,975,243 | A | 11/1999 | Lorbek |
| 6,009,977 | A | 1/2000 | Pelofi |
| 6,029,777 | A | 2/2000 | Rogelja |

(Continued)

OTHER PUBLICATIONS

Non-Final Rejection mailed in U.S. Appl. No. 14/676,604 dated Sep. 1, 2017, 11 pp.

*Primary Examiner* — Alvin C Chin-Shue
(74) *Attorney, Agent, or Firm* — Lathrop Gage LLP

(57) ABSTRACT

A belay device may include a front plate with a first lobe and a back plate with a second lobe. The belay device may be engageable and disengageable such that the first lobe is separated from the second lobe at a first distance and a second distance, respectively. The belay device may maintain ability to operate when the belay device is disengaged. The belay device may include a handle and cam pin that cooperate to create a mechanical advantage for controlling separation distance between the first and second lobe. The handle may prevent rotation in a first direction via a lockout protrusion. The handle may prevent rotation in a second direction via a handle stop and/or a retaining rib. The belay device may include an ergonomic feature to accommodate a user's hand placement and/or shroud rotation of the front plate.

20 Claims, 9 Drawing Sheets

(56) References Cited

U.S. PATENT DOCUMENTS

| | | | | |
|---|---|---|---|---|
| 6,155,384 | A | 12/2000 | Paglioli | |
| 6,378,650 | B2 | 4/2002 | Mauthner | |
| 6,446,753 | B1 | 9/2002 | Novak | |
| 2002/0112916 | A1* | 8/2002 | Ador | A62B 1/14 182/5 |
| 2003/0196853 | A1* | 10/2003 | LeBeau | A62B 1/14 182/5 |
| 2005/0051385 | A1* | 3/2005 | Klingler | A62B 1/14 182/5 |
| 2006/0207829 | A1 | 9/2006 | Mauthner | |
| 2007/0215411 | A1 | 9/2007 | Petzl | |
| 2008/0245611 | A1 | 10/2008 | Klingler | |
| 2008/0302600 | A1 | 12/2008 | Murray | |
| 2009/0120720 | A1* | 5/2009 | Arms | A62B 1/14 182/193 |
| 2011/0073417 | A1* | 3/2011 | Chaumontet | A62B 1/14 188/65.5 |
| 2011/0258815 | A1* | 10/2011 | Everette | A62B 1/14 24/134 R |
| 2012/0111665 | A1 | 5/2012 | Paglioli | |
| 2012/0241700 | A1 | 9/2012 | Mauthner | |
| 2013/0032433 | A1* | 2/2013 | Codega | A62B 1/14 182/5 |
| 2013/0180800 | A1* | 7/2013 | Mauthner | A62B 1/14 182/5 |
| 2016/0287913 | A1* | 10/2016 | Bell | A62B 1/20 |

* cited by examiner

BELAY DEVICE

RELATED APPLICATIONS

This application claims priority to U.S. Provisional Application Ser. No 62/360,838, filed Jul. 11, 2016, and which is incorporated herein in its entirety.

BACKGROUND

Rock climbing involves the challenge of navigating a rock face which is often essentially vertical. Rock climbing and rappelling have recently become more popular, as have other so-called "extreme" sports. Rock climbing offers individuals an opportunity to be outdoors and participate in an activity that is both rewarding and challenging, while at the same time being non-destructive to the natural environment.

At the start of the climb, the climber will determine the path to be taken as the climber ascends the rock face. The climber will generally need to use his or her entire body as that ascent takes place. Beyond the climber's body, a number of pieces of equipment are generally used by the rock climber. This equipment varies from climbing shoes equipped with tough rubber soles, to sewn harnesses, to special climbing rope.

The sport of climbing or mountaineering typically requires a team of two people. To ensure the safety of the climber, the climber ties into a rope, via a harness worn by the climber, and is belayed by a partner (the "belayer"). While the climber ascends, the belayer takes up or lets out the rope such that the rope is maintained taut between the climber and belayer, preventing a fall of any great distance by the climber.

BRIEF DESCRIPTION OF THE FIGURES

The foregoing and other features and advantages of the disclosure will be apparent from the more particular description of the embodiments, as illustrated in the accompanying drawings, in which like reference characters refer to the same parts throughout the different figures. The drawings are not necessarily to scale, emphasis instead being placed upon illustrating the principles of the disclosure.

DETAILED DESCRIPTION OF THE EMBODIMENTS

Figure 1:
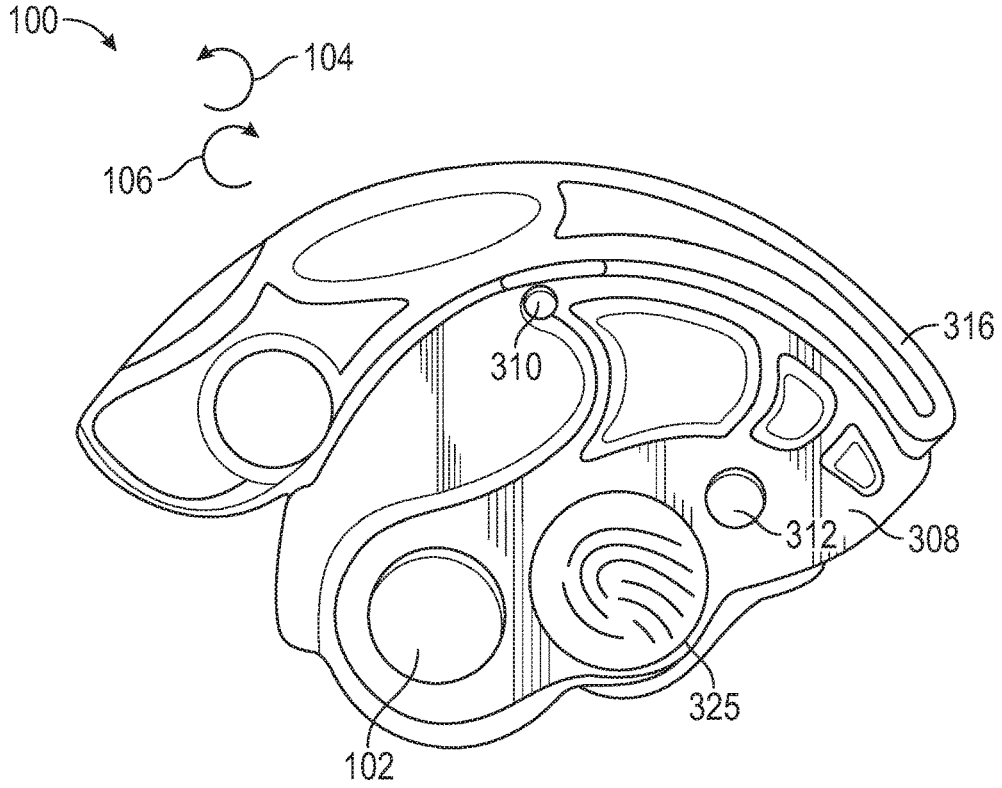
FIG. 1 depicts a top plan view of a belay device, in embodiments.
Figure 2:
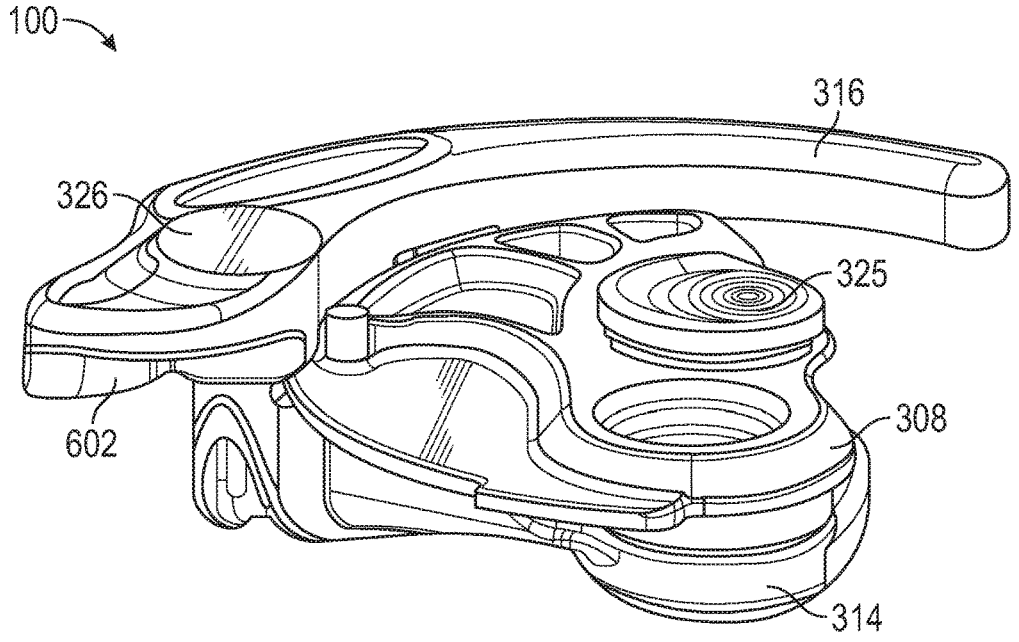
FIG. 2 depicts a top perspective view of the belay device system, of FIG. 1.
Figure 3:
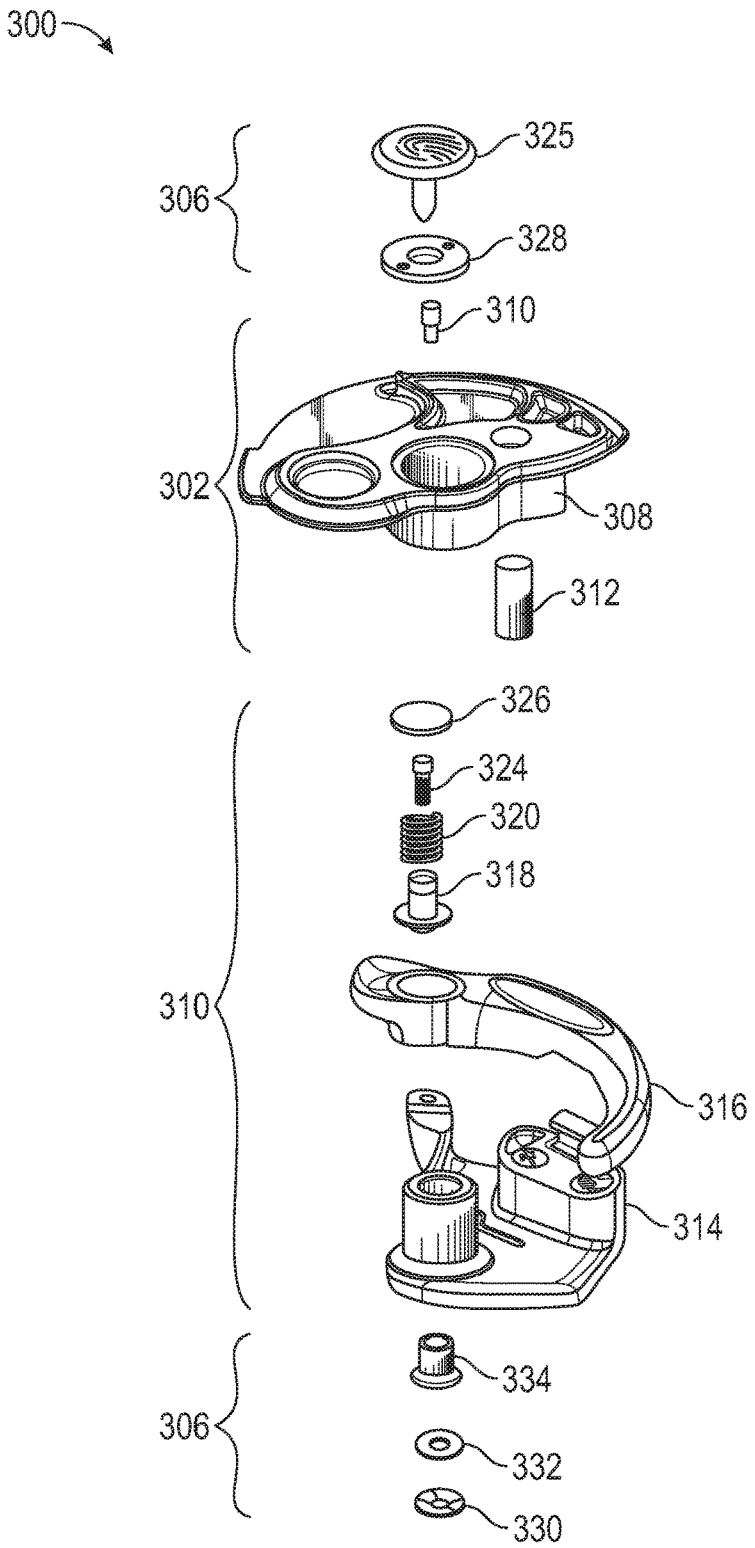
FIG. 3 depicts an exploded view of the belay device of FIG. 1.
Figure 4:
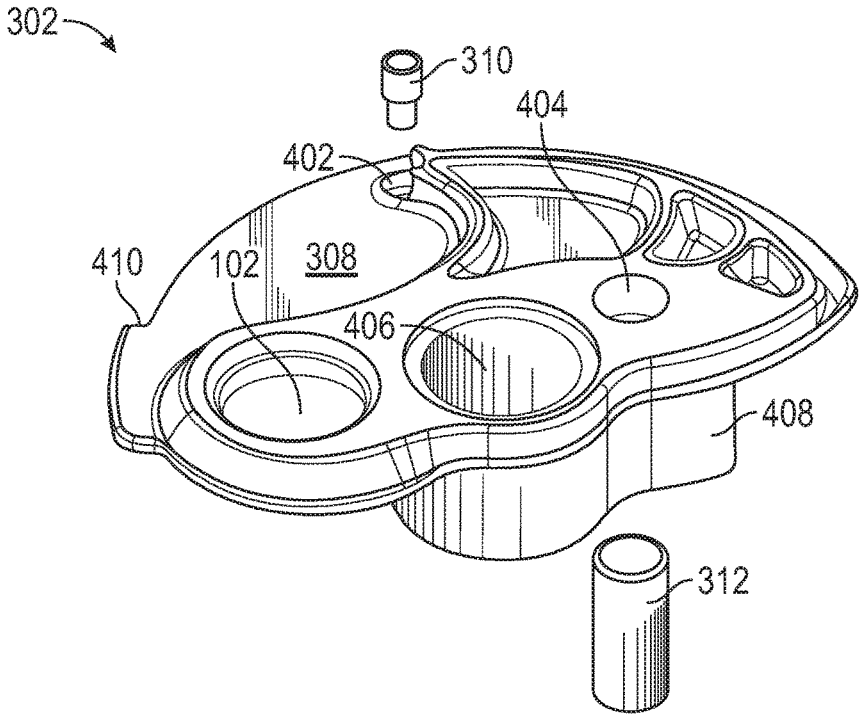
FIG. 4 depicts the front-plate subassembly of the belay device, of FIG. 1, in further detail.
Figure 5:
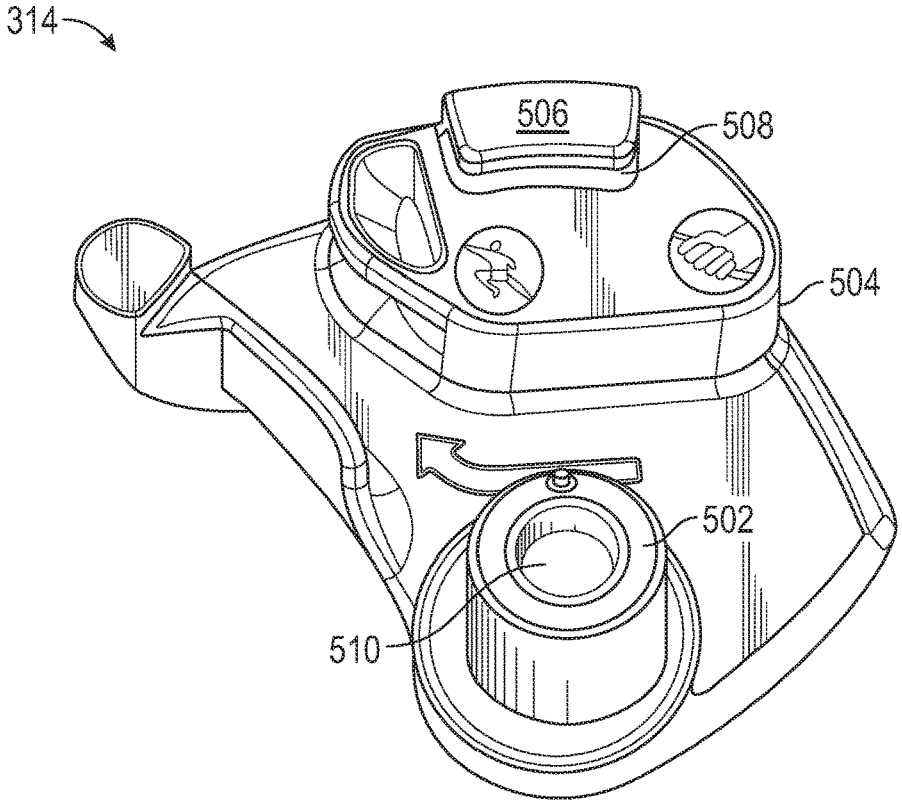
FIG. 5 depicts the back plate of the belay device of FIG. 1, in further detail.
Figure 6:
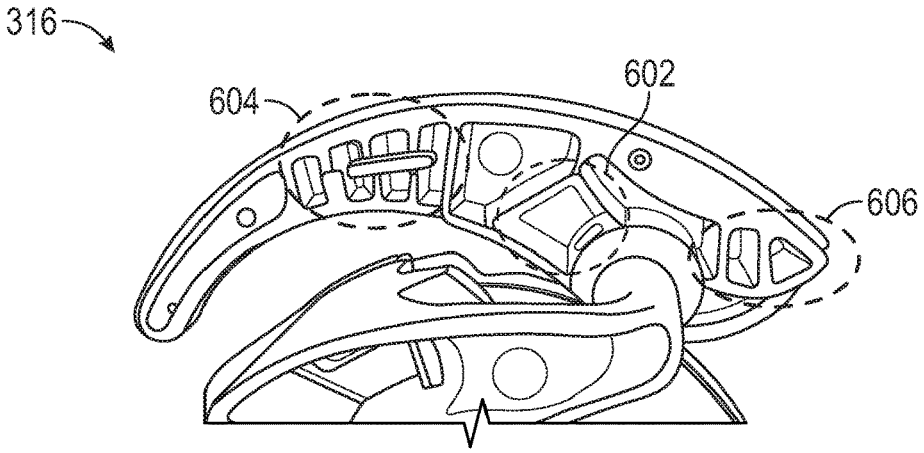
FIG. 6 depicts the handle of the belay device of FIG. 1, in further detail.
Figure 7A:
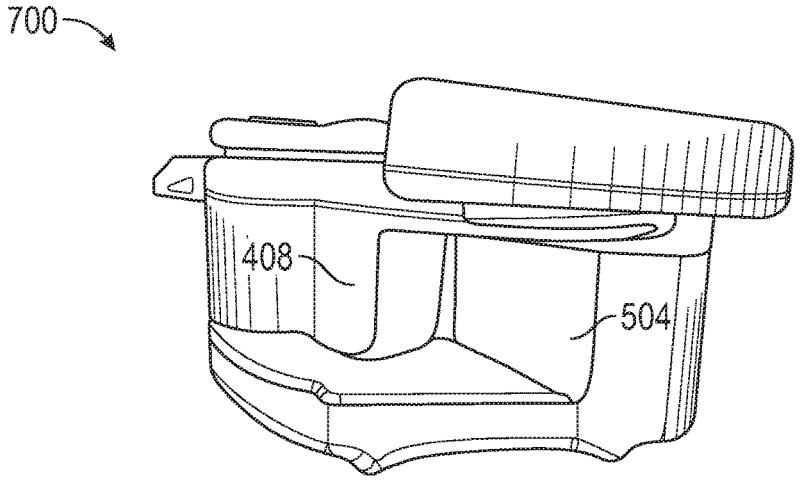
FIGS. 7A-B depict the lobes of the belay device of FIG. 1 in separated and unseparated distances, respectively.
Figure 7B:
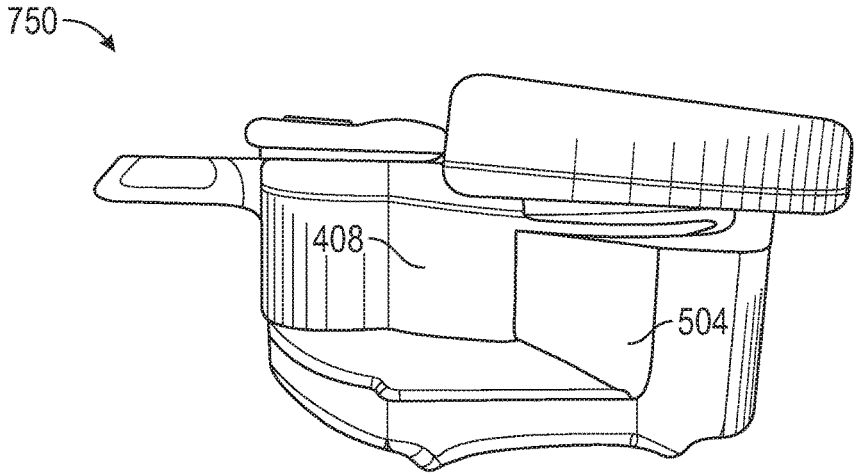
Figure 8A:
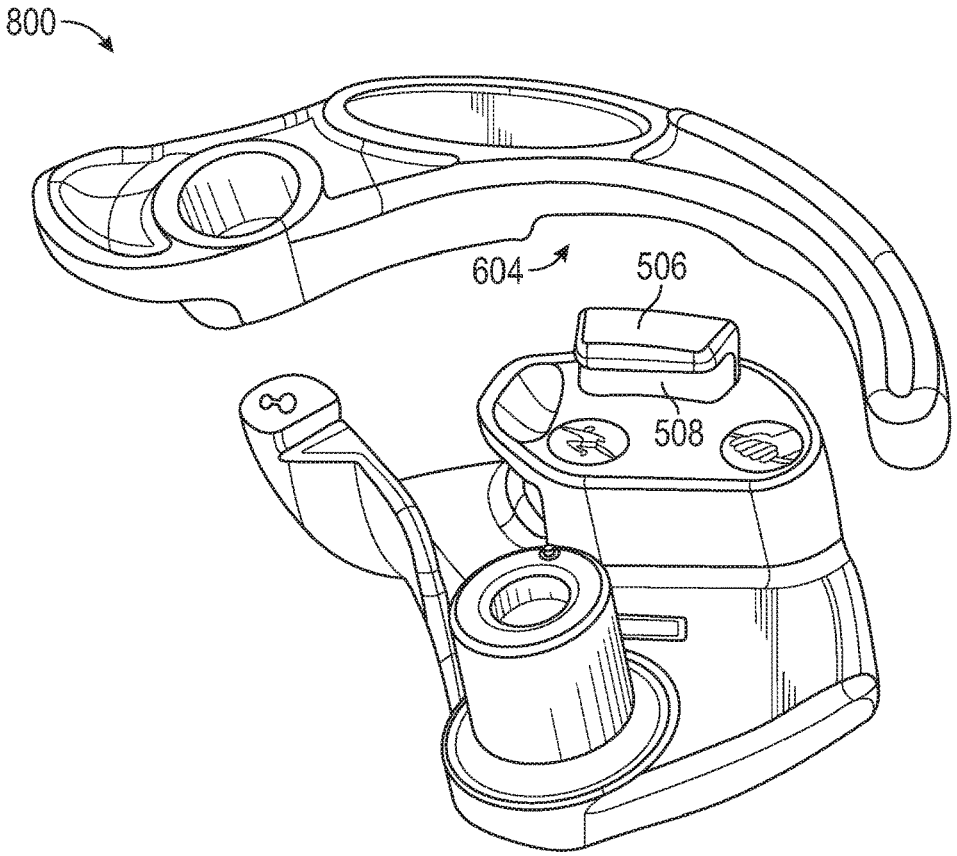
FIGS. 8A-B depicts interaction between the handle stop protrusion and handle stop notch of the handle of the belay device of FIG. 1, in embodiments.
Figure 8B:
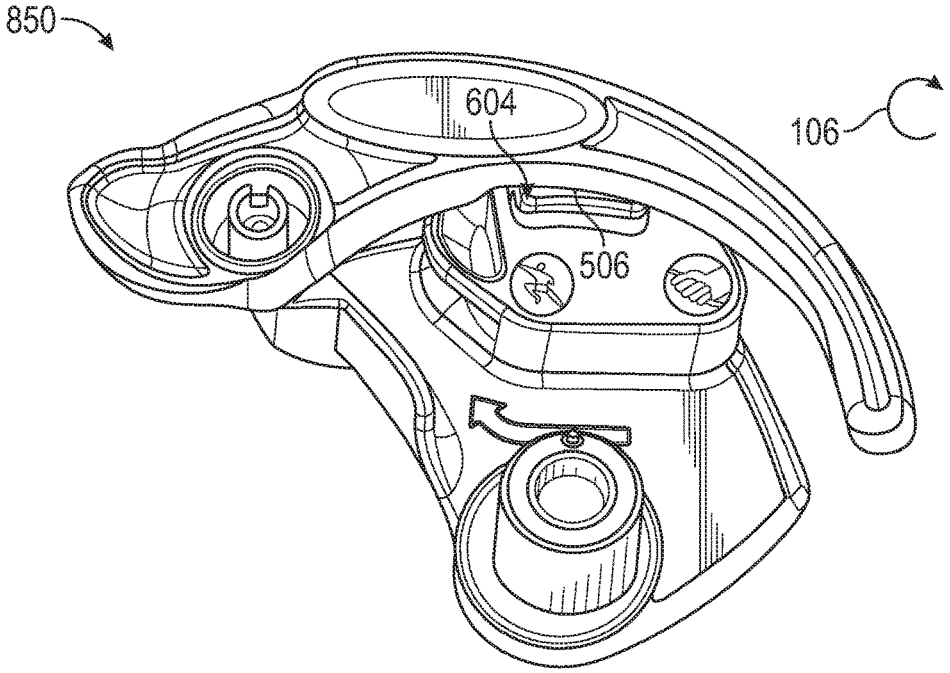

FIG. 1 depicts a top plan view of a belay device 100, in embodiments. FIG. 2 depicts a top perspective view of belay device system 100, of FIG. 1. FIG. 3 depicts an exploded view 300 of the belay device system 100, of FIG. 1. FIG. 4 depicts the front-plate subassembly of belay device 100, in further detail. FIG. 5 depicts the back plate 314 of belay device 100, in further detail. FIG. 6 depicts the handle 316 of belay device 100, of FIG. 1, in further detail. FIGS. 7A-B depict the lobes of the belay device in separated and unseparated distances, respectively. FIGS. 8A-B depicts interaction between handle stop protrusion 508 and handle stop notch 604 of handle 316, in embodiments. FIGS. 9A-9D depicts various views with handle 316 of belay device 100 causing rotation of front plate 308 with respect to back plate 314. FIGS. 1-9D are best viewed together with the following description.

Belay device 100 clips to a user's harness (not shown) via carabiner clip aperture 102. Belay device 100 includes one or more of a front-plate subassembly 302, a back-plate/handle subassembly 304, and a final assembly portion 306. Referring to FIG. 3, front-plate subassembly 302 includes some or all of front plate 308, cam pin 310 and friction pin 312. Back-plate/handle subassembly 304 includes some or all of back plate 314, handle 316, handle standoff 318, spring 320, screw 324, and handle cap 326. It should be appreciated that screw 324 and/or handle standoff 318 may be replaced by a rivet without departing from the scope hereof. In embodiments including final assembly 306, final assembly 306 includes thumb rest 325, washer 328, push nut 330, wave spring 332, and rivet 334.

As shown in FIG. 4, front plate 308 of front-plate subassembly 302 may include cam-pin aperture 402, friction pin aperture 404, and boss aperture 406. Front plate 308 may be formed of a hardened metal, plastic, resin, or other material having sufficient load bearing properties.

Cam pin aperture 402 receives cam pin 310 for attachment of cam pin 310 to front plate 308. Thus, cam pin 310 may be welded, bonded, threaded or otherwise attached to front plate 308 via cam pin aperture 402. It should be appreciated that in other embodiments, cam pin aperture 402 is not necessary because cam pin 310 is formed integrally to, and thus from the same material as, front plate 308.

Friction pin aperture 404 receives friction pin 312. Thus, friction pin 312 may be welded, bonded, threaded or otherwise attached to front plate 308 via friction pin aperture 404. It should be appreciated that in other embodiments, friction pin aperture 404 is not necessary because friction pin 312 is formed integrally to, and thus from the same material as, front plate 308. Friction pin 312 may thus be replaceable as friction pin 312 wears due to use of belay device 100.

Boss aperture 406 receives boss 502 (discussed below) of back plate 314. Therefore, front plate 308 rotates about boss 502 with respect to back plate 314.

Front plate 308 may further include a first lobe 408. Separation between first lobe 408 and a second lobe 504 (discussed below) of back plate 314 as front plate 308 rotates about boss 502. For example, referring to FIGS. 7A and 7B, view 700 of FIG. 7A depicts first lobe 408 separated from second lobe 504. On the other hand, view 750 of FIG. 7B depicts first lobe 408 adjacent second lobe 504 based on rotation of front plate 308 to back plate 314 about boss 502.

Front plate 308 may further include a lockout stop 410. Lockout stop 410 interacts with lockout protrusion 602, discussed in further detail below, to prevent handle 316 from further rotation in a counter-clockwise direction 104 (referring to FIG. 1). Handle 316 may interact with both lockout stop 410 and cam pin 310 in a lockout position.

As shown in FIG. 5, back plate 314 may include boss 502, second lobe 504, and handle stop protrusion 506. Back plate 314 may be formed of a hardened metal, plastic, resin, or other material having sufficient load bearing properties. Back plate 314 may be made of the same or a different material than front plate 308. The arrow between boss 502 and second lobe 504 indicates the direction of rope during use of belay device 100. The rope (not shown) goes through the channel defined by boss 502, second lobe 504, and first lobe 408, and then above the climber for anchoring to the climbing surface.

Boss 502 couples with boss aperture 406 of front plate 308 such that front plate 308 may rotate about boss 502.

Second lobe 504 cooperates with first lobe 408 to apply pressure on rope within the channel defined thereby. Accordingly, when the climber falls, the separation distance between first lobe 408 and second lobe 504 decreases thereby applying friction on the rope to stop the climber's fall.

Handle stop protrusion 506 interacts with handle stop notch 604 of handle 316. View 800 of FIG. 8A shows handle 316 separated from back plate 314. On the other hand, view 850 of FIG. 8B shows handle 316 including handle stop notch 604 interacting with handle stop protrusion 506 such that handle 316 cannot rotate any further in clockwise direction 106. Handle stop protrusion 506 may further including a retaining flange that provides a front plate channel 508 in which an edge of front plate 308 passes through. For example, referring to FIGS. 9A-9B, edge 902 of front plate 308 is passing through front plate channel 508.

As shown in FIG. 6, handle 316 includes one or more features enabling functionality of the handle. For example, handle 316 may include lockout protrusion 602, handle stop notch 604, and cam pin interface 606. Handle 316 may be formed of a hardened metal, plastic, resin, or other material having sufficient load bearing properties. Handle 316 may be made of the same or different material as front plate 308 and back plate 314.

Referring back to FIG. 3, handle 316 may be secured to back plate 314 via handle standoff 318 and spring 320, screw 324 and handle cap 326. It should be appreciated that a rivet may alternatively be used instead of standoff 318 and/or screw 324 to secure handle 316 to back plate 314 without departing from the scope hereof. For example, handle standoff 318 may provide a separation distance between back plate 314 and handle 316. Spring 320 may bias handle 316 against back plate 314. For example, spring 320 may bias handle 316 such that handle stop notch 604 is biased against handle stop protrusion 506 as discussed below. Screw 324 (and/or a rivet) may secure handle 316 to back plate 314. Handle cap 326 may cover spring 320 and/or screw 324 from view by the user.

Referring now back to FIG. 6, as discussed above, lockout protrusion 602 interacts with lockout stop 410 to prevent handle 316 from rotating further in a first direction (i.e. counter clockwise direction 106). It should be appreciated that lockout protrusion 602 may be a lockout notch, or other shape or configuration without departing from the scope hereof. Accordingly, lockout stop 410 may also have various shapes and configuration that complement the given shape/configuration of lockout protrusion 602 without departing from the scope hereof.

Figure 12:
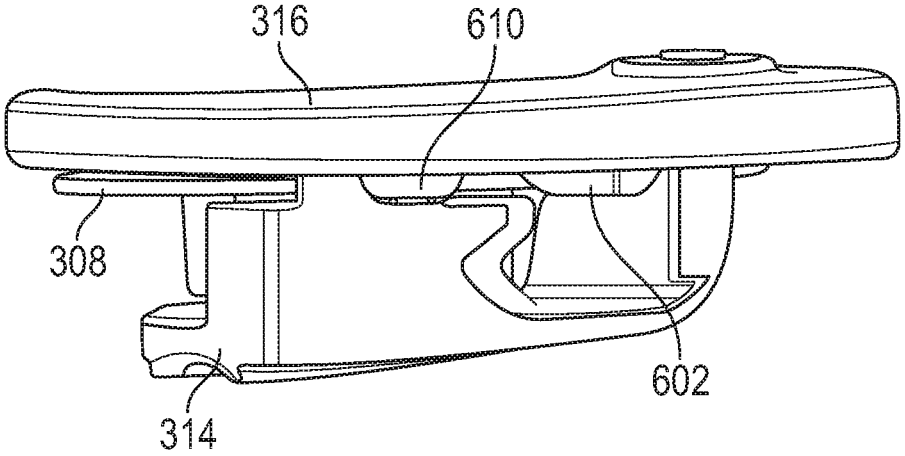
FIG. 12 depicts a side perspective view of the belay device of FIG. 1, in embodiments.

Further, handle stop notch 604 interacts with handle stop protrusion 506 to prevent handle 316 from rotating further in a second direction (i.e. clockwise direction 104). It should be appreciated that handle stop notch 604 may be a protrusion, or other shape or configuration without departing from the scope hereof. Accordingly, handle stop protrusion 506 may be a notch, or other shapes or configuration complementing the given shape/configuration of handle stop notch 604 without departing from the scope hereof. Handle stop notch 604 may be flush with a plane defined by the bottom surface 608. Alternatively (or additionally), handle may include a retaining rib 610 that extends beyond surface 608 to further prevent handle 316 from rotating in the second direction, even if handle is pulled in a third direction orthogonal to the second direction (e.g., away from back plate 314). In embodiments, retaining rib 614 may be a protrusion that extends substantially the same height as lockout protrusion 602. Retaining rib 610 is shown in FIG. 12 as separate from lockout protrusion 602. It should be appreciated, however, that retaining rib 610 may be integral with lockout protrusion 602.

Figure 9A:
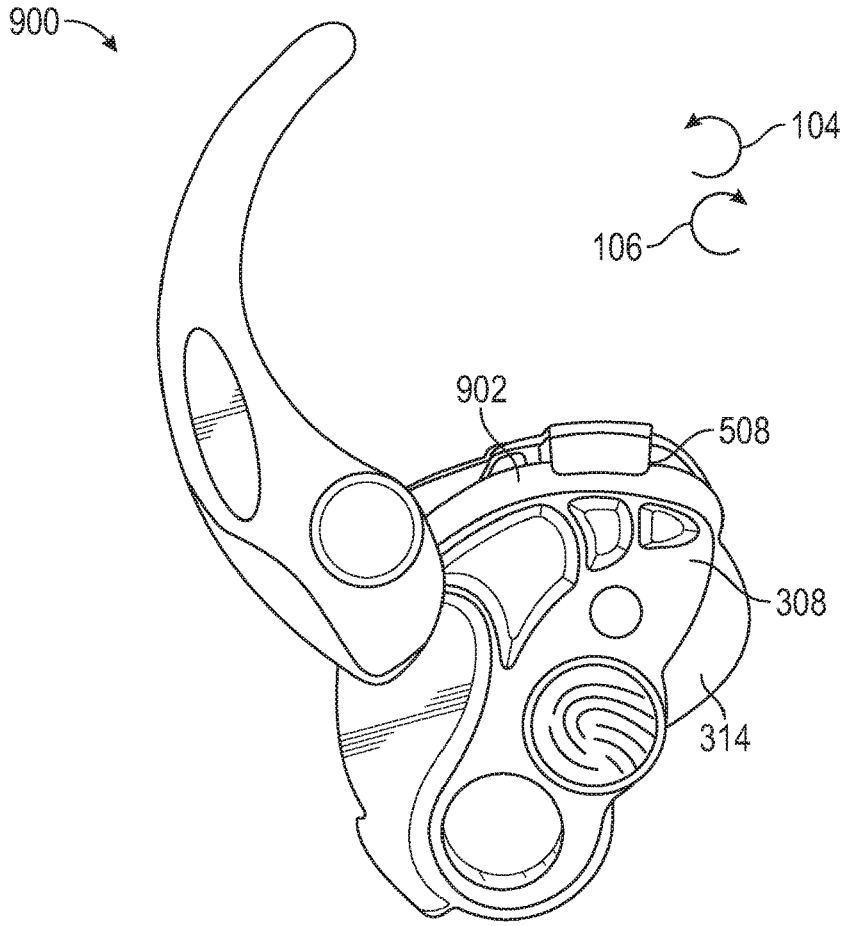
FIGS. 9A-9D depicts various views with the handle of the belay device of FIG. 1 causing rotation of front plate with respect to the back plate, in embodiments.
Figure 9B:
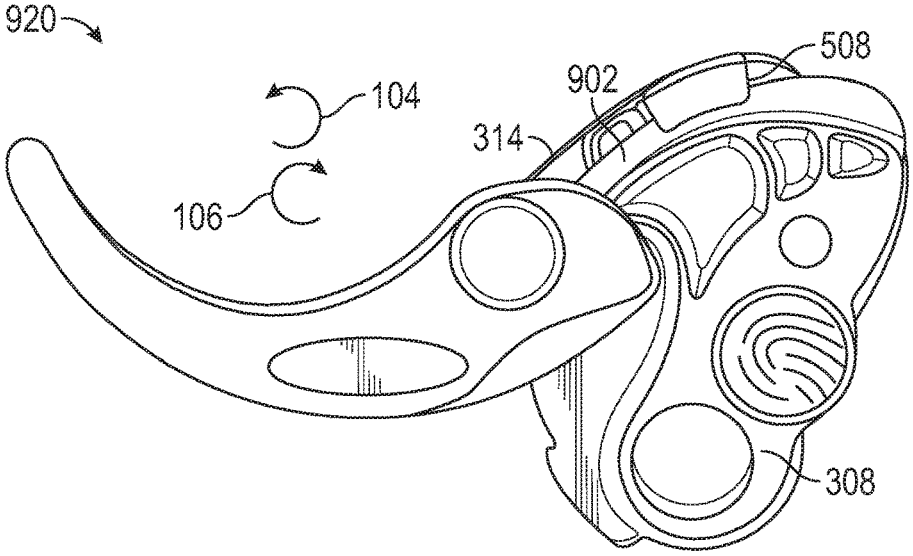
Figure 9C:
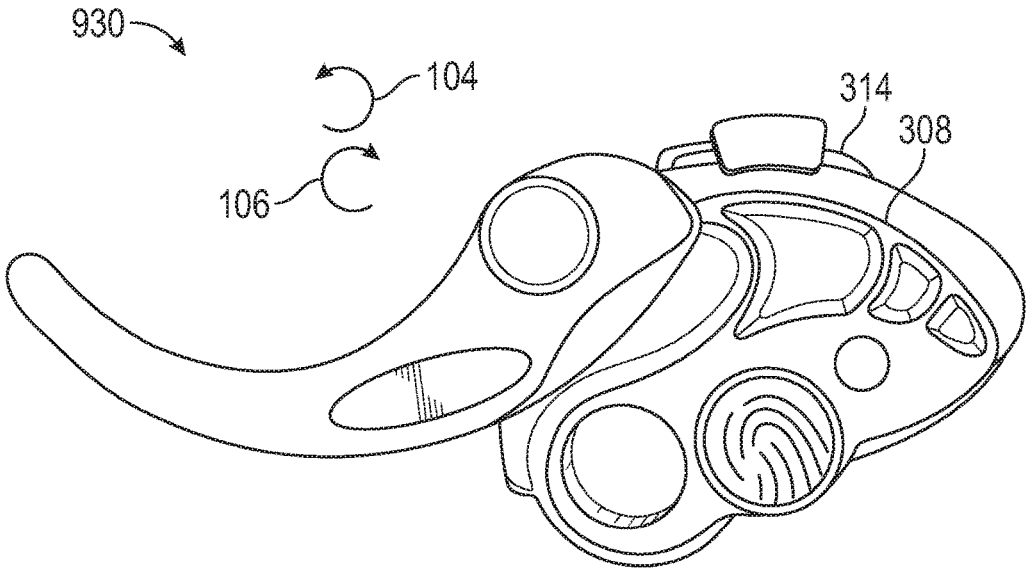
Figure 9D:
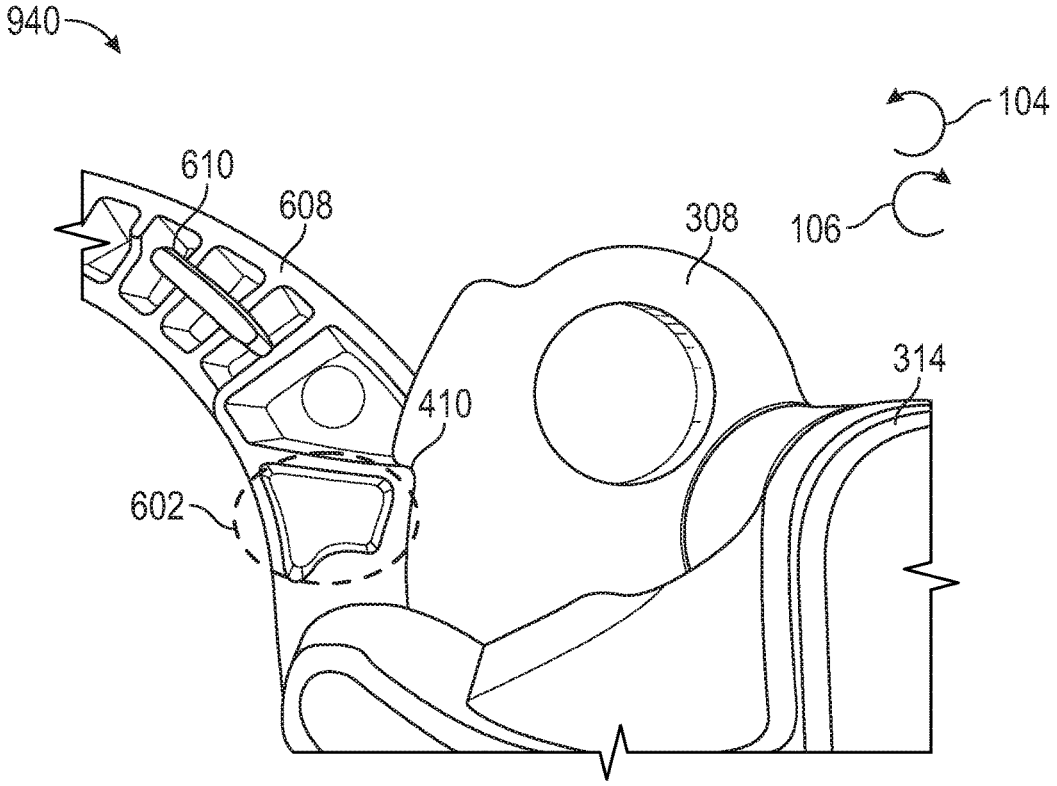

Cam pin interface 606 interacts with cam pin 310 to minutely control the separation distance between first lobe 408 and second lobe 504. In one example, cam pin interface 606 is a notch within handle 316 that interacts with cam pin 310. As discussed above, when the climber falls, or otherwise puts weight on the rope, the separation distance between first lobe 408 and second lobe 504 is reduced, thereby causing the surface of friction pin 312 to clamp, or otherwise "brake," on the rope and stop the climber from falling. In order for the climber to reduce this braking action, the front plate 308 must be counter rotated with respect to the back plate 314 such that the separation distance increases. To illustrate this counter-rotation, view 900 of FIG. 9A compared to each of views 920, and 930, of FIGS. 9B-C, respectively shows front plate 308 rotating in a clockwise direction 106 with respect to back plate 314. As handle 316 is rotated in a counter clockwise direction 104, cam pin interface 606 interacts with cam pin 310 to cause front plate 308 to rotate in a clockwise direction 106. View 930 is depicts a top view, and view 940 of FIG. 9D depicts a bottom view, of the full rotation of handle 316 until lockout protrusion 602 interacts with lockout stop 410 thereby preventing further rotation of front plate 308 with respect to back plate 314.

Cam pin interface 606 may interact with the cam pin 310 for an entire useable range of motion until lockout protrusion 602 interacts with lockout stop 410 thereby preventing further rotation of handle 316.

Cam pin interface 606 provides a mechanical advantage to the amount of braking force applied between cam pin 310 and second lobe 504. In one embodiment, this mechanical advantage is a non-variable mechanical advantage. In another embodiment, this mechanical advantage is a single-stage, continuously variable mechanical advantage. In another embodiment, mechanical advantage is a variable mechanical advantage in that the mechanical advantage changes for a first portion of notch 606, and then plateaus for a second portion of notch 606, and then additionally changes for a third portion of notch 606. As such, in embodiments, cam pin interface 606 may provide a mechanical advantage changing from less than one to greater than one.

Referring to FIG. 3, front plate subassembly 302 and back-plate subassembly 304 may be secured together via final assembly 306. For example, boss 502 may be inserted into boss receiving aperture 406. Rivet 334 may then be placed within rivet receiving aperture 510 (FIG. 5) and riveted around washer 328 such that front plate 308 is secured around boss 502 to back plate 314.

In embodiments including thumb rest 325, thumb rest 325 may secure to push nut 330 with wave spring 332 there between.

Belay device 100 may, in embodiments, further include various ergonomic features for handling the belay device-handle cap 326

Figure 10:
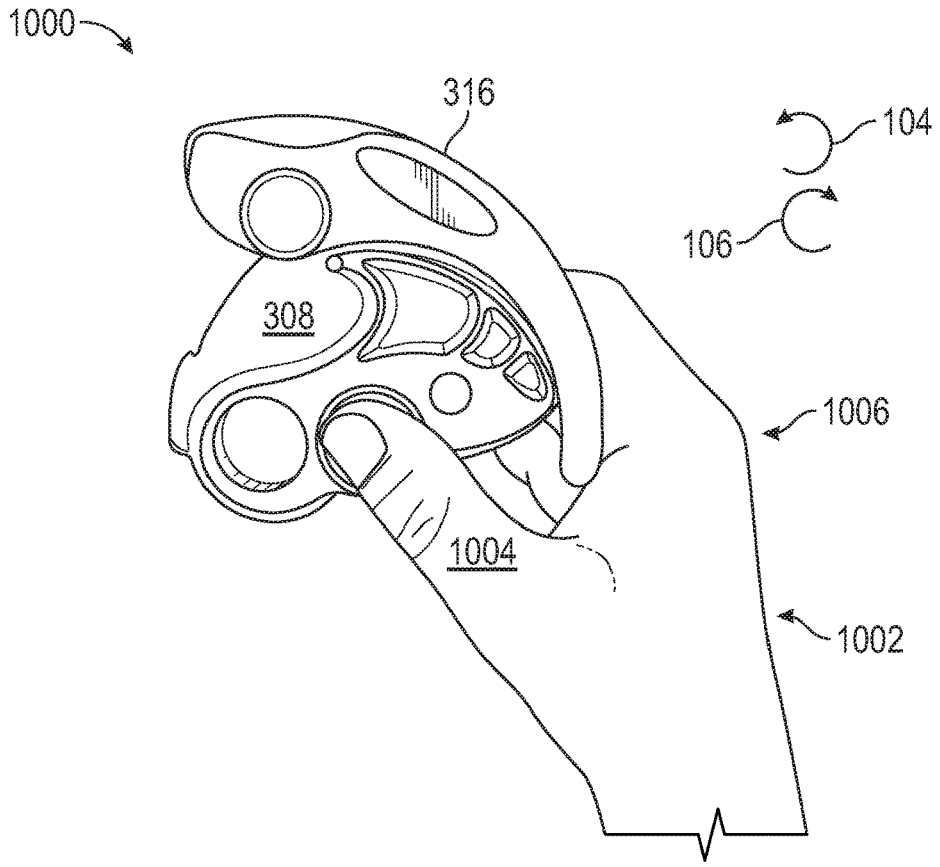
FIG. 10 depicts an exemplary handling placement of the belay device of FIG. 1, in one embodiment.
Figure 11:
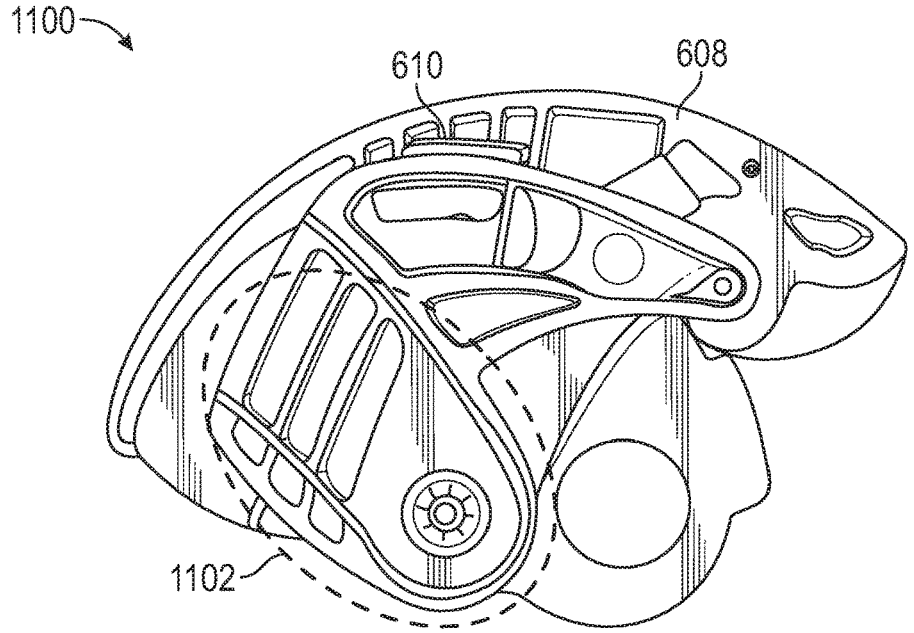
FIG. 11 depicts back view of the belay device of FIG. 1 illustrating an ergonomic finger groove, in embodiments.

FIG. 10 depicts an exemplary handling placement 1000, in one embodiment. FIG. 11 depicts back view of belay device 100 illustrating an ergonomic finger groove 1102. FIGS. 10-11 are best viewed together with the following description.

Thumb rest 325, discussed above with respect to at least FIG. 3, provides an intuitive handling placement easing the use of belay device 100 by the user. For example, as shown in FIG. 10, the user's hand 1002 is placed with thumb 1004 on thumb rest 325. This instinctively requires the user's other fingers 1006 to wrap at least partially around belay device 100. Referring now to FIG. 11, as the user's other fingers 1006 wrap around the belay device 100, the user's index or forefinger will instinctively reside in finger groove 1102. Finger groove 1102 is integral to back plate 314. This placement 1000 provides an ergonomic handling of belay device 100 that is not present in prior belay devices.

In addition, placement 1000 allows front plate 308 to freely rotate during handling of device 100 according to placement 1000. Further, handle 316 may be sized and shaped such that handle 316 shrouds the rotation of front plate 308, thereby increasing reliability and ease of use of belay device 100. This ability to freely rotate while still handling the device provides many advantages.

At least one of which is the ability to disengage the device 100 from the rope, while maintaining operation of the device. In certain circumstances, it may be desirable for the climber to make a fast movement, such as various dyno moves, that would otherwise cause the belay device 100 to engage (i.e. separation between first lobe 408 and second lobe 504 to decrease, thereby braking the device to the rope). One such way to disengage the device 100, while referring to FIG. 10, is to, using the device user's palm of his or her left hand (not shown) counter rotate front plate 308 in a clockwise direction 106 while holding the rope, exiting the device in the top of the figure, with the fingers of his or her left hand. Should the climber fall, the movement in the rope will cause the user's left hand to travel with the rope and thereby remove the palm from the front plate 308. At this time, the device 100 will re-engage and prevent the climber from falling.

This is a significant departure from prior art belay devices. In the prior art belay devices, the user would have to physically clamp two or more plates of the device such that the separation distance always is apart. The user, with these prior art devices, had to render the device inoperable in order to disengage it. This led to unnecessary falls and injuries of the climbers being supported by the prior art belay devices.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A belay device comprising:

a front plate including:

an integral first lobe, a cam pin located on the front plate, and a carabiner attachment aperture;

a back plate with an integral second lobe; and, a handle including a cam pin interface for interacting with the cam pin to create a mechanical advantage for controlling separation distance between the first and second lobe via rotation of the front plate with respect to the back plate.

2. The belay device of claim 1, the handle further including a lockout protrusion to prevent the handle from rotating in a first direction at a lockout position, the lockout position being defined by a position that the lockout protrusion interacts with a lockout stop integral to the front plate.

3. The belay device of claim 2, the handle further including a handle stop notch on a bottom surface of the handle to prevent the handle from rotating, in a second direction opposite the first direction, past a handle stop protrusion located on the second lobe of the back plate.

4. The belay device of claim 3, the handle stop protrusion including a retaining flange providing a front plate channel in which an edge of the front plate passes through.

5. The belay device of claim 2, the handle further including a retaining rib to prevent the handle from rotating in a second direction opposite the first direction.

6. The belay device of claim 2, the cam pin interface interacting with the cam pin through an entire useable range of motion until reaching the lockout position.

7. The belay device of claim 6, further including at least one ergonomic feature shrouding rotation of the front plate.

8. A belay device comprising at least one ergonomic feature to accommodate a user's hand placement.

9. The belay device of claim 8, the ergonomic feature including a finger groove.

10. The belay device of claim 8, the ergonomic feature including a thumb pad.

11. The belay device of claim 8, the ergonomic feature shrouding rotation of a front plate of the belay device.

12. The belay device of claim 1, the cam pin interface being a notch in the handle.

13. A belay device comprising:

a front plate including a first lobe, a cam pin located on the front plate, and a carabiner attachment aperture;

a back plate with a second lobe; and, a handle including a cam pin interface for interacting with the cam pin to create a mechanical advantage for controlling separation distance between the first and second lobe;

the belay device being engageable such that the first lobe is separated from the second lobe at a first distance;

the belay device being disengageable such that the first lobe is separated from the second lobe at a second distance greater than the first distance;

the belay device maintaining ability to operate when the belay device is disengaged.

14. The belay device of claim 13, the handle further including a lockout protrusion to prevent the handle from rotating in a first direction at a lockout position, the lockout position being defined by a position that the lockout protrusion interacts with a lockout stop integral to the front plate.

15. The belay device of claim 14, the handle further including a handle stop notch on a bottom surface of the handle to prevent the handle from rotating, in a second direction opposite the first direction, past a handle stop protrusion located on the second lobe of the back plate.

16. The belay device of claim 15, the handle stop protrusion including a retaining flange providing a front plate channel in which an edge of the front plate passes through.

17. The belay device of claim 14, the handle further including a retaining rib to prevent the handle from rotating in a second direction opposite the first direction.

18. The belay device of claim 17, the retaining rib protruding a same distance as the lockout protrusion.

19. The belay device of claim 14, the cam pin interface interacting with the cam pin through an entire useable range of motion until reaching the lockout position.

20. The belay device of claim 13, the cam pin interface being a notch in the handle.

* * * * *